US005403083A

United States Patent [19]

Dasher et al.

[11] Patent Number: 5,403,083

[45] Date of Patent: Apr. 4, 1995

[54] LATERALLY ADJUSTABLE CANTILEVER SHELF FOR A REFRIGERATOR

[75] Inventors: James F. Dasher, Center Township, Vanderburgh County, Ind.; Jeffrey A. DeBoer, Ann Arbor, Mich.

[73] Assignee: Whirlpool Corporation, Benton Harbor, Mich.

[21] Appl. No.: 24,020

[22] Filed: Mar. 1, 1993

[51] Int. Cl.[6] ..... A47B 96/00; A47B 88/04

[52] U.S. Cl. ..... 312/408; 108/137; 312/270.3

[58] Field of Search ..... 312/408, 304, 301, 35, 312/321; 108/137, 143; 211/187, 184, 59.2, 59.3, 126

[56] References Cited

U.S. PATENT DOCUMENTS

| | | | |
|---|---|---|---|
| 3,067,882 | 12/1962 | Ribbens et al. | 211/136 |
| 3,242,885 | 3/1966 | Baker et al. | 108/137 |
| 3,268,858 | 8/1966 | Klotz | 312/270 |
| 3,311,072 | 3/1967 | Pattison | 108/143 |
| 3,334,954 | 8/1967 | Kesling | 312/304 |
| 3,633,983 | 1/1972 | Whitcomb | 312/306 |
| 3,984,163 | 10/1976 | Boorman et al. | 312/270 |
| 5,139,322 | 8/1992 | Aisley | 312/351 |

*Primary Examiner*—Stephen C. Pellegrino
*Assistant Examiner*—Nancy Connolly Mulcare
*Attorney, Agent, or Firm*—Thomas J. Roth; Stephen D. Krefman; Robert O. Rice

[57] ABSTRACT

A laterally adjustable cantilever shelf system for a refrigerator/freezer includes a formed metal bracket which defines a continuous channel. The bracket includes hooks to engage into slots in shelf standards in a refrigerated compartment. This enables the bracket to be placed at any select vertical position within the compartment. A shelf accessory includes sheet metal side arms each having a hook at the top rear that mates with a channel in the bracket to retain the shelf. Sufficient clearance is provided between the shelf side arm and the channel to allow the shelf to be moved by slightly lifting the front of the shelf to relieve the pressure between the top hook and the channel and applying lateral pressure. An additional hook at the bottom of the side arm interferes with the channel when the front of the shelf is lifted to prevent the shelf from becoming accidentally dislodged. The storage accessory is removed by raising the rear of the shelf, tipping the bottom hook of the side arm out of the channel and then tipping the top hook out of the channel.

13 Claims, 1 Drawing Sheet

LATERALLY ADJUSTABLE CANTILEVER SHELF FOR A REFRIGERATOR

FIELD OF THE INVENTION

This invention relates generally to a refrigeration apparatus and, more particularly, to a laterally adjustable shelf storage system.

BACKGROUND OF THE INVENTION

A typical refrigeration apparatus, such as a refrigerator/freezer, includes one or more refrigerated compartments. The compartments includes a plurality of shelves, which shelves may be stationary or selectively positionable, as is well known. The selective positioning of the latter type shelf generally relates to the vertical position of the shelf within the compartment. The spacing above each shelf must be sufficient so that food product containers of various sizes can be placed thereon without interference. This factor limits the number of shelves which can be provided. With a given number of shelves, this can also limit the ability to store relatively tall items within the refrigerator compartment.

The present invention is intended to overcome one or more of the problems as set forth above.

SUMMARY OF THE INVENTION

In accordance with the present invention, a refrigeration apparatus shelf storage system is provided which enables lateral adjustment of position of a shelf storage system.

Broadly, there is disclosed herein a laterally adjustable storage system in a refrigeration apparatus having a cabinet including a refrigerated compartment with a rear wall connecting opposite side walls. The storage system includes a continuous bracket mounted in said compartment to extend laterally across the rear wall. A storage accessory stores items to be refrigerated. The storage accessory includes rearwardly extending hook means adjacent a rear marginal edge thereof for mating with the bracket in any lateral position thereof so that the storage accessory can be positioned at any lateral position in the compartment as determined by a select mating position of the hook means to the bracket.

It is a feature of the invention that the bracket defines a continuous channel for receiving the hook means.

It is another feature of the invention that the bracket defines a continuous, frontwardly opening channel for receiving the hook means.

It is a further feature of the invention that the storage accessory includes a pair of laterally spaced side arms, each side arm including a hook at a rear end thereof defining the hook means and engageable With the bracket.

It is a further feature of the invention that the hook means is removably received in the bracket.

It is yet another feature of the invention that the rear wall includes a plurality of laterally spaced shelf standards, each having a plurality of vertically spaced slots and the bracket includes a plurality of rearwardly extending hooks receivable in the slots for mounting the bracket at a select vertical position in the compartment.

In accordance with the invention, the storage system includes a formed metal bracket which defines a continuous channel. The bracket includes hooks to engage into the slots in the shelf standards normally used to retain cantilevered shelves in the compartment. This enables the bracket to be placed at any select vertical position within the compartment. The storage accessory includes sheet metal side arms each having a hook at the top rear that mates with the channel to retain the shelf. Sufficient clearance is provided between the shelf side arm and the channel to allow the shelf to be moved by slightly lifting the front of the shelf to relieve the pressure between the top hook and the channel and applying lateral pressure. An additional hook at the bottom of the side arm interferes with the channel when the front of the shelf is lifted to prevent the shelf from becoming accidentally dislodged. The storage accessory is removed by raising the rear of the shelf, tipping the bottom hook of the side arm out of the channel and then tipping the top hook out of the channel.

Further features and advantages of the invention will readily be apparent from the specification and from the drawings.

DETAILED DESCRIPTION OF THE INVENTION

Figure 1:
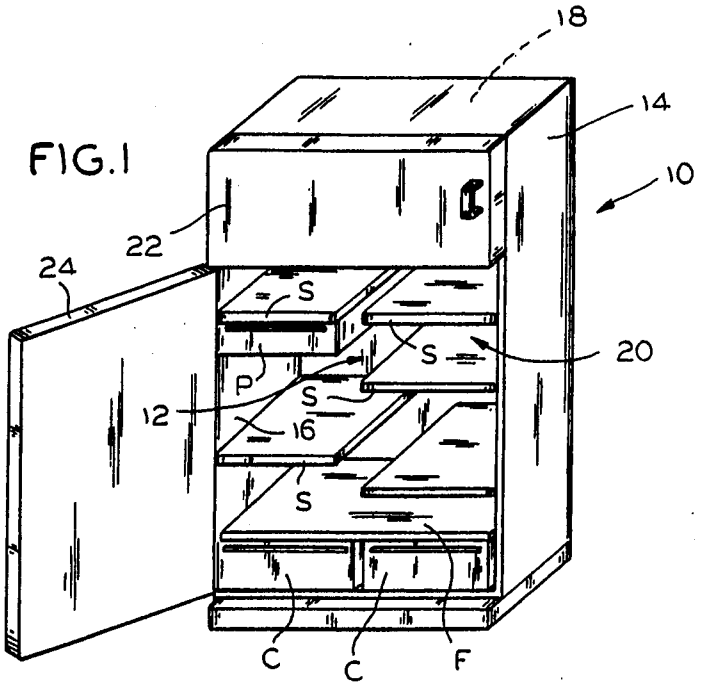
FIG. 1 is a perspective view illustrating a refrigeration apparatus including the shelf storage system according to the invention.

Referring to FIG. 1, a refrigeration apparatus, such as a refrigerator/freezer 10, includes a shelf storage system 12 according to the invention. The system is shown utilized with a top mount unit, however, other types of refrigeration apparatus may be used in conjunction with the shelf storage system of the present invention, as will be obvious to those skilled in the art.

The refrigerator/freezer 10 includes a cabinet 14 provided with an internal liner 16 and an insulating separator or divider wall (not shown) to provide a below-freezing, or freezer compartment 18 and a fresh food, or above-freezing, compartment 20. Each of the compartments 18 and 20 comprises a storage space refrigerated in a conventional manner. Access to the freezer compartment 18 is provided through a freezer door 22. Access to the fresh food compartment 20 is provided through a fresh food door.

As is conventional with a refrigerator/freezer 10, maximum use should be made of the refrigerated space. This is done by subdividing the fresh food compartment 20 using various storage systems, including the shelf storage system 12 according to the invention. Such storage systems can take many known forms and may consist of shelves S or storage pans P. Normally, the storage pans P suspend from a shelf S. Also provided are crisper pans C generally positioned below a fixed shelf F. Typically, the shelves S and pans P are cantilevered and vertically adjustable but mounted at select lateral positions within the compartment 20. In accordance with the invention, position of either may be laterally adjusted within the compartment 20.

Figure 2:
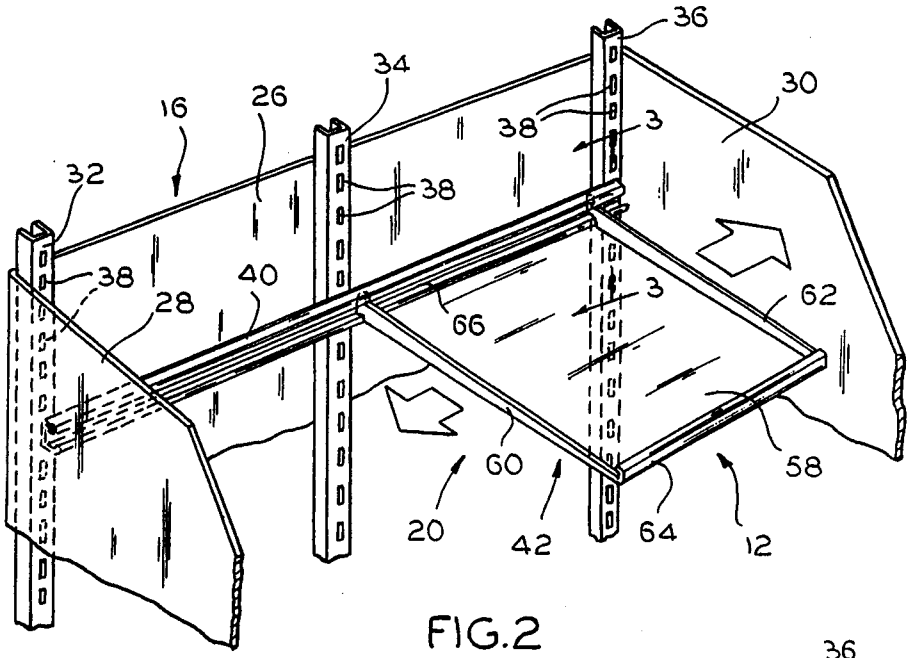
FIG. 2 is a partial, perspective view specifically illustrating the adjustable shelf storage system according to the invention.

With reference to FIG. 2, the liner 16 comprises a rear wall 26 connecting opposite side walls 28 and 30. Three vertical bracket ladders or standards 32, 34 and 36 of conventional construction are mounted in any known manner to the rear wall 26. The vertical standards 32, 34 and 36 are laterally spaced, with the first standard 32 being positioned immediately adjacent the first side wall 28, the second standard 34 being centrally located and the third standard 36 being located proximate the second side wall 30. Each standard 32, 34 and 36 includes longitudinally extending and longitudinally spaced slots 38, as is well known. The standards 32, 34 and 36 can be used to mount conventional cantilevered shelves S or pans P at any select vertical height within the compartment 20, such shelves S or pans P being either half width or full width. As such, the shelves S would be mounted to span a space between the first and second standards 32 and 34, or the second and third standards 34 and 36 or the entire width between the first and third standards 32 and 36. In accordance with the invention, the shelf storage system 12 includes a shelf which can be selectively positioned at any lateral position between the side walls 28 and 30.

Figure 3:
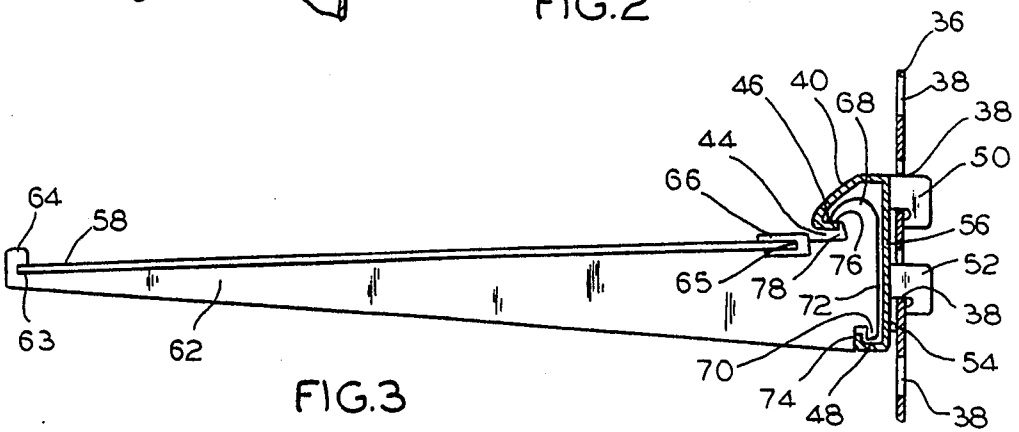
FIG. 3 is a sectional view taken along the line 3—3 of FIG. 2.

The shelf storage system 12 comprises a bracket 40 and a shelf storage accessory 42. With reference also to FIG. 3, the bracket 40 comprises an elongate continuous, formed sheet metal bracket defining a frontwardly opening channel 44. Particularly, the bracket 40, in cross-section, resembles an upside down "G" having a continuous inwardly directed upper lip 46 and a continuous upwardly directed bottom lip 48. A pair of conventional shelf hooks 50 and 52 extend rearwardly from a rear wall 56 of the bracket 40 at each of three lateral positions. The three lateral positions correspond to the positions of the shelf standards 32, 34 and 36. The hooks 50 and 52 are received in the standard slots 38 for mounting the bracket 40 at any select vertical position within the compartment, as with conventional shelf hooks and standards. A small nipple 54 extends rearwardly from the rear wall 56 beneath each hook 52 for bearing on the particular shelf standard 32, 34 or 36 to maintain orientation of the bracket 40 in a desired position with the rear wall 56 in a generally vertical orientation parallel to each standard, such as the standard 36 shown in FIG. 3.

The shelf storage accessory 42 may take one of many known forms. In the illustrated embodiment, the shelf storage accessory 42 comprises a glass shelf 58 secured to parallel, opposite side arms 60 and 62. The glass shelf 58 is generally rectangular and has front and rear marginal edges 63 and 65 received in respective front and rear trim strips 64 and 66. The trim strips 64 and 66 are secured to the side arms 60 and 62 in any known manner.

With particular reference to FIG. 3, the side arm 62 includes a top hook 68 and bottom hook 70 adjacent a rear marginal edge 72 thereof. The bottom hook 70 is defined by a downwardly opening notch 74 spaced frontwardly of the rear marginal edge 72. The top hook 68 extends upwardly from the side arm 62 at the rear marginal edge 72 and extends forwardly immediately above a frontwardly opening notch 78 to define a catch 76.

Although not specifically illustrated, the side arm 60 is identical in construction to the side arm 62, albeit a mirror image thereof.

The side arms 60 and 62 mate with the bracket 40 as by the arm rear marginal edge 72 being received in the bracket channel 44. The bracket bottom lip 48 extends upwardly into the notch 74. The bracket top lip 46 extends into the notch 78 with the hook catch 76 bearing on the bracket top lip 46. There is sufficient clearance with the notch 78 to allow the shelf 58 to be moved laterally by slightly lifting the front of the shelf 58 to relieve pressure between the top hook catch 76 and the channel top lip 46 and applying lateral pressure. The bottom hook 70 engages the bottom lip 48 to prevent the shelf storage accessory 42 from becoming accidentally dislodged.

In accordance with the above-described storage system, a laterally adjustable cantilever shelf 58 is provided. Although not specifically illustrated, the side arms 60 and 62, or equivalent structure having hooks 68 and 70, could be used in connection with a storage pan P or any other refrigeration apparatus storage accessory for storing items to be refrigerated.

Figure 4:
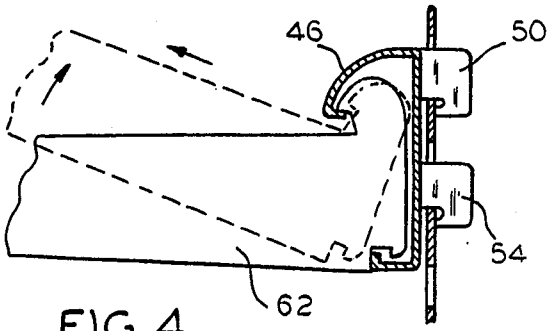
FIG. 4 is a view similar to that of FIG. 3 illustrating removability of the shelf storage system.

To remove the shelf storage accessory 42, sufficient clearance is provided between the top hook 68 and an upper portion of the channel 44 so that if the rear of the shelf 58 is raised and then the shelf 58 is tipped clockwise, then the bottom hook 70 clears the bottom lip 48. This is particularly illustrated in dashed lines in FIG. 4. Thereafter, the top hook 68 can be tipped out of the channel 44 for removal. This can be done to facilitate vertical repositioning of the bracket 40 or for cleaning or replacement of the shelf storage accessory 42, as necessary or desired.

Thus, in accordance with the invention there is disclosed an adjustable shelf storage system 12 which satisfies the need for such a feature in the marketplace. The adjustable shelf storage system 12 allows a user to laterally adjust the position of the shelf storage accessory 42 along a continuous bracket 40 to accommodate storage of tall items. Additionally, the design of the side arm hooks 68 and 70 along with the bracket 40 ensures that the shelf storage accessory 42 does not become accidentally dislodged from the channel 44 while the shelf storage accessory is being moved.

The foregoing disclosure is illustrative of the broad inventive concepts comprehended by the invention.

We claim:

1. A laterally adjustable refrigeration apparatus storage system comprising:

a rear wall;

a pair of opposite sidewalls;

said rear wall connecting said pair of opposite sidewalls and defining a refrigerated compartment;

a continuous bracket mounted in said compartment extending laterally across said rear wall;

a storage accessory having a rear marginal edge adjacent said bracket, said storage accessory including hook means adjacent said rear marginal edge for mating with said bracket at any lateral position thereof; and said bracket defining a continuous, frontwardly opening channel.

2. The laterally adjustable storage system of claim 1 wherein said storage accessory includes a pair of laterally spaced side arms, each said side arm including a hook defining said hook means and engageable with said bracket.

3. The laterally adjustable storage system of claim 1 wherein said storage accessory includes a pair of laterally spaced side arms, each said side arm including a top hook defining said hook means for mating with said bracket and each said side arm also including a bottom hook also for mating with said bracket.

4. The laterally adjustable storage system of claim 1 wherein said hook means is removably received on said bracket.

5. The laterally adjustable storage system of claim 1 wherein said rear wall includes a plurality of laterally spaced shelf ladders, each having a plurality of vertically spaced slots and said bracket includes a plurality of hooks receivable in said slots.

6. A laterally adjustable refrigeration apparatus storage system comprising:

a compartment having a first and second oppositely facing sidewalls and a rear wall;

a plurality of laterally spaced vertical shelf ladders mounted on said rear wall, a continuous bracket mounted in said compartment extending laterally across said rear wall from first side wall to second oppositely facing side wall;

a shelf storage accessory including a pair of laterally spaced side arms, each said side arm including hook means engageable with said bracket adapted to engage said bracket at any lateral position thereof; and said bracket defining a continuous frontwardly opening channel for receiving said hook means.

7. The laterally adjustable shelf storage system of claim 6 wherein each said side arm includes a hook defining said hook means and receivable in said channel.

8. The laterally adjustable shelf storage system of claim 6 wherein each said side arm includes a top hook defining said hook means receivable in said channel and each said side arm also includes a bottom hook also receivable in said channel.

9. The laterally adjustable shelf storage system of claim 6 wherein said hook means is removably received on said bracket.

10. The laterally adjustable shelf storage system of claim 6 wherein each said shelf ladder has a plurality of vertically spaced slots and said bracket includes a plurality of hooks receivable in said slots.

11. A laterally adjustable refrigeration apparatus storage system comprising:

a rear wall;

a plurality of laterally spaced vertical shelf ladders mounted on said rear wall, a continuous bracket mounted to said shelf ladder extending laterally across said rear wall, said bracket including a continuous channel;

a shelf storage accessory including a pair of laterally spaced side arms each said side arm including a hook received in said channel at a select lateral position thereof; and said bracket defining a continuous, frontwardly opening channel for receiving said hooks.

12. The laterally adjustable shelf storage system of claim 11 wherein said hooks are received in said channel such that said hooks bear downwardly on a lip in said bracket such that said hooks retain said shelf storage accessory at the select lateral position until said hook is lifted off of said lip.

13. The laterally adjustable storage system of claim 11 wherein each said shelf ladder has a plurality of vertically spaced slots and said bracket includes a plurality of hooks receivable in said slots.

* * * * *